US006393727B1

(12) United States Patent
Seelig et al.

(10) Patent No.: US 6,393,727 B1
(45) Date of Patent: May 28, 2002

(54) METHOD FOR REDUCING VOC EMISSIONS DURING THE MANUFACTURE OF WOOD PRODUCTS

(75) Inventors: Keith David Seelig; Robert Carl Middlesforf, both of Hayward, WI (US); Wu-Hsiung Ernest Hsu; Jim Evensen, both of Tualatin, OR (US)

(73) Assignee: Louisiana-Pacific Corporation, Portland, OR (US)

( * ) Notice: Subject to any disclaimer, the term of this patent is extended or adjusted under 35 U.S.C. 154(b) by 0 days.

(21) Appl. No.: 09/677,402

(22) Filed: Sep. 29, 2000

Related U.S. Application Data

(60) Provisional application No. 60/157,257, filed on Oct. 1, 1999.

(51) Int. Cl.[7] ..... F26B 7/00

(52) U.S. Cl. ..... 34/396; 34/218; 34/219; 34/77; 34/78

(58) Field of Search ..... 34/396, 85, 86, 34/218, 219, 77, 78, 79, 493, 497, 330

(56) References Cited

U.S. PATENT DOCUMENTS 3,647,353 A * 3/1972 Calzaferri et al. ..... 34/493
3,946,495 A 3/1976 Osdor ..... 34/15
4,058,634 A * 11/1977 Kunz ..... 34/330
4,182,048 A * 1/1980 Wolfe et al. ..... 34/396
4,196,526 A * 4/1980 Berti ..... 34/396
4,213,947 A * 7/1980 Fremont et al. ..... 34/396
4,339,883 A 7/1982 Waldmann ..... 34/27
4,403,948 A * 9/1983 Waldmann et al. ..... 34/396
4,430,948 A 2/1984 Waldmann et al. ..... 432/1
4,663,860 A * 5/1987 Beall ..... 34/396
4,810,258 A 3/1989 Greene ..... 44/33
5,253,432 A 10/1993 Raiko et al. ..... 34/35
5,271,162 A * 12/1993 Kunz et al. ..... 34/493
5,357,881 A 10/1994 Elcik et al. ..... 110/346
5,524,361 A 6/1996 Dexter et al. ..... 34/502
5,618,333 A 4/1997 Bucholtz, Jr. et al. ..... 95/237
5,665,798 A 9/1997 Speaks et al. ..... 524/14
5,697,167 A * 12/1997 Kunz et al. ..... 34/86
5,698,667 A 12/1997 Speaks et al. ..... 530/202
5,728,185 A 3/1998 Bucholtz, Jr. et al. ..... 55/222
5,749,160 A 5/1998 Dexter et al. ..... 34/502
5,758,434 A * 6/1998 Gipson ..... 34/396

* cited by examiner

*Primary Examiner*—Teresa Walberg
*Assistant Examiner*—Fadi H. Dahbour
(74) *Attorney, Agent, or Firm*—Marger Johnson & McCollom, P.C.

(57) ABSTRACT

A system for drying wood particles and a method of operation wherein the wood particles are introduced into a dryer and contacted directly with a combustion system exhaust stream. VOC's emitted from the wood particles during drying are recycled to the combustion system for destruction. In one method according to the invention, a portion of the VOC-laden dryer exhaust stream is recycled to the dryer.

36 Claims, 9 Drawing Sheets

METHOD FOR REDUCING VOC EMISSIONS DURING THE MANUFACTURE OF WOOD PRODUCTS

This application is a continuation-in-part of U.S. application Ser. No. 60/157,257, filed Oct. 1, 1999.

This invention is related to a method and apparatus for controlling VOC emissions from wood-product processing and manufacturing plants. More particularly, the invention is related to controlling VOC emissions during the drying of wood particles prior to their further processing into engineered wood products. In another aspect, the invention is related to efficiently utilizing the thermal energy generated during the manufacturing process.

Oriented strand board (OSB) is manufactured by first debarking the logs, and then breaking or "waferizing" the wood into relatively small, thin wafer or strand like particles. The wood wafers are then dried. During the drying of wafers, volatile organic compounds (VOC's) are also emitted from the wood particles into the drying air stream. The emitted VOC's are entrained in the large volumes of heated air fed into the wafer dryers, and in air which is extracted from the workspaces in certain areas of the plant.

Current environmental regulations require containment and destruction of nearly all of the VOC's emitted during the drying of the wood particles. The containment and destruction of the VOC's is very expensive, both in terms of capital costs and operating costs. The high cost of controlling the VOC's is due primarily to the large volumes of air that must be treated, rather than the overall amounts of VOC's emitted. Containment and control of VOC's is currently achieved by the use of large thermal reactors known as Regenerative Thermal Oxidizers (RTO's). RTO's burn a fuel (natural gas) to generate the high temperatures necessary to destroy the VOC's. Multiple RTO's are normally used, and are expensive to build, operate and maintain. As a result, RTO's represent a sizable fraction of the initial cost of a new plant, and of the ongoing operating expenses associated with an OSB plant.

Turning now to FIG. 1, a typical OSB manufacturing process is shown in greater detail. Green wafers are transferred from green bin 10 into dryer 12 where the green wafers are dried from 100% of their green moisture content (MC) down to about 4–7%. The dried wafers and VOC-laden gas stream exit the drier 12 and are separated in cyclone 14. The dried wafers and fines are separated from the gas stream. The gas stream is sent to wet electrostatic precipitator 16 where the fine particulates are removed, and then RTO 18 where the VOC's are thermally oxidized and destroyed before the gas stream is discharged to the atmosphere. In another section of the facility, VOC's emitted from the press vent 20 are collected from the surrounding area in a relatively large volume air stream as discussed above, and introduced into a second RTO 22 where the VOC's are destroyed.

In other known methods of controlling VOC's, all or part of the drying air stream is recycled to a high temperature burner where the VOC's are destroyed. EP 0 457 203 discloses a method wherein a major portion of the drying air stream is continuously recycled within the dryer. A second portion is continuously separated from the recycled drying air and is fed to a condenser where the high boiling components, including some VOC's, are removed. The remainder of the stream is then introduced into a burner where any remaining hydrocarbons are destroyed. The VOC containing liquid generated in this method must be treated, which is difficult to achieve in typical biological sewage treatment plants. Another known method that is taught in EP-A-O 459 603 is similar, except that the condensation step is omitted. A portion of the recycled drying air stream is separated and fed directly into a burner where the hydrocarbons are destroyed. Each of these methods, while purporting to limit VOC emissions, requires the use of heat exchangers to transfer heat from the combustion stream to the drying air stream. In each of these methods, combustion gases at about 900 degrees F. are fed into a heat exchanger to heat the drying air stream to about 500 degrees F. In the portion of the heat exchanger where the combustion gases are introduced, the drying air stream is at about 500 degrees F. The heat exchanger suffers rapid degradation in those areas due to the high temperatures.

A prior art method shown in U.S. Pat. No. 5,697,167 to Kunz, et al attempts to address this problem and reduce the stress on the heat exchanger. As with the methods described above, the drying air stream is recycled with a small portion being separated and fed into the burner. In this method however, the recycled portion and the combustion gases are first introduced into a supplemental heat exchanger where the combustion gases are partially cooled and the recycled drying air stream is partially heated. Since the maximum temperature of the recycled drying air is lower, the heat exchanger runs cooler, extending the life of the heat exchanger. The combustion gases and the drying air stream are then introduced into a main heat exchanger wherein the drying air stream is heated to about 500 degrees F. as before. However, the combustion gases are partially cooled, resulting in a lower maximum temperature in the heat exchanger. In this way, the heat-induced stress on both heat exchangers is reduced. In the supplemental heat exchanger, the lower exit temperature of the drying air stream serves to cool the heat exchanger in the area where the combustion gases are introduced. In the main heat exchanger, the lower inlet temperature of the combustion gases results in a lower maximum temperature in the heat exchanger.

This method, while an improvement over the earlier methods, nonetheless has major limitations. First, an additional supplemental heat exchanger is required. Even though the lower temperatures extend the lives of the supplemental and main heat exchangers, the heat exchangers still represent a major capital and operating expense. Second, this method's efficiency is limited by the maximum practical combustion gas temperature. As mentioned, the heat exchangers are degraded under conditions of inlet gas temperatures of about 900 degrees F. The temperature limitations of the heat exchangers aside, the maximum temperature of combustion gas stream is limited to about 1100 degrees F. Higher temperatures cause slugging problems in the heat exchanger, which result in significantly higher operating expenses. Slagging occurs when the combustion gas temperature is high enough to melt salts in entrained in the combustion gases. The molten salts then deposit and solidify on the cooler heat exchanger surfaces, causing plugging and reducing the heat transfer efficiency of the heat exchanger.

Applicants have discovered a novel method of drying the green wafers or other wood particles which reduces the volume of air in which the VOC's are entrained, and by which the emission of the VOC's from drying wafers can be advantageously controlled. The novel method reduces the RTO capacity required by a significant degree while at the same time recovering the fuel values of the VOC's which have heretofore been lost. Finally, the need to use one or more heat exchangers to heat a drying air stream with combustion gases can be eliminated entirely. These and other aspects of the invention will now be described in greater detail by reference to the drawings.

DETAILED DESCRIPTION OF THE INVENTION

Figure 1A:
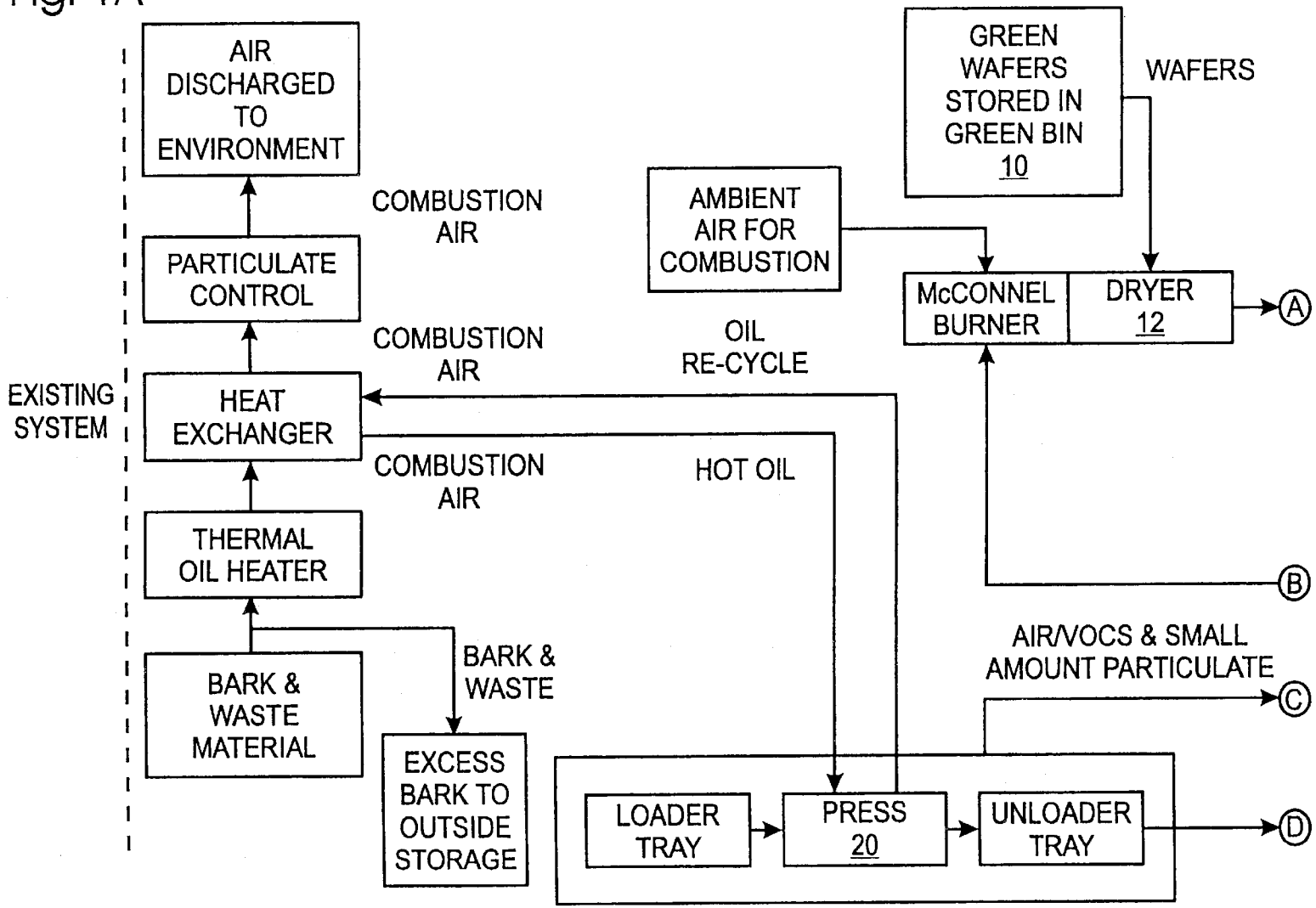
FIG. 1 is a schematic of a known process for drying wafers and forming them into engineered products.
Figure 1B:
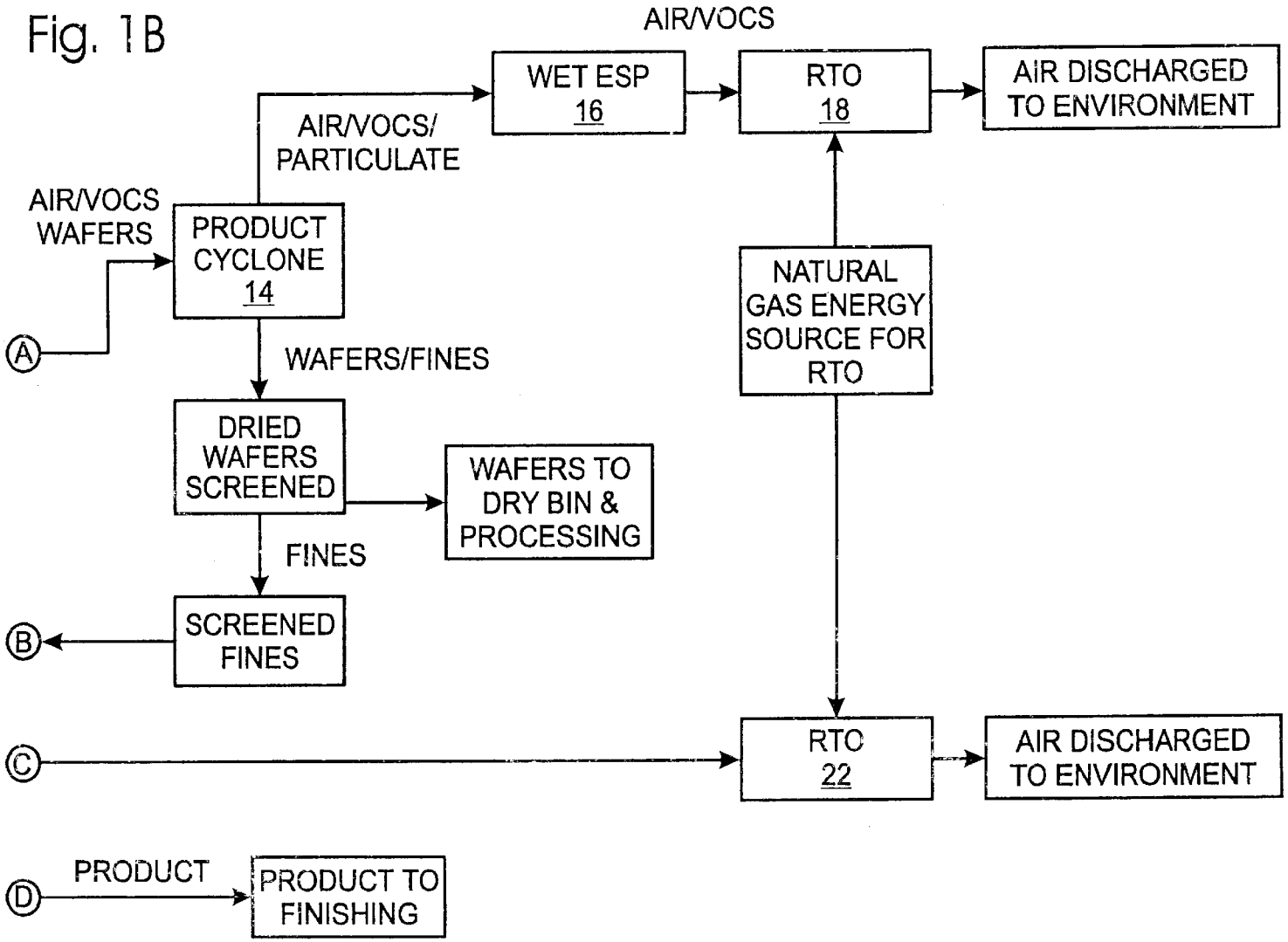
Figure 2A:
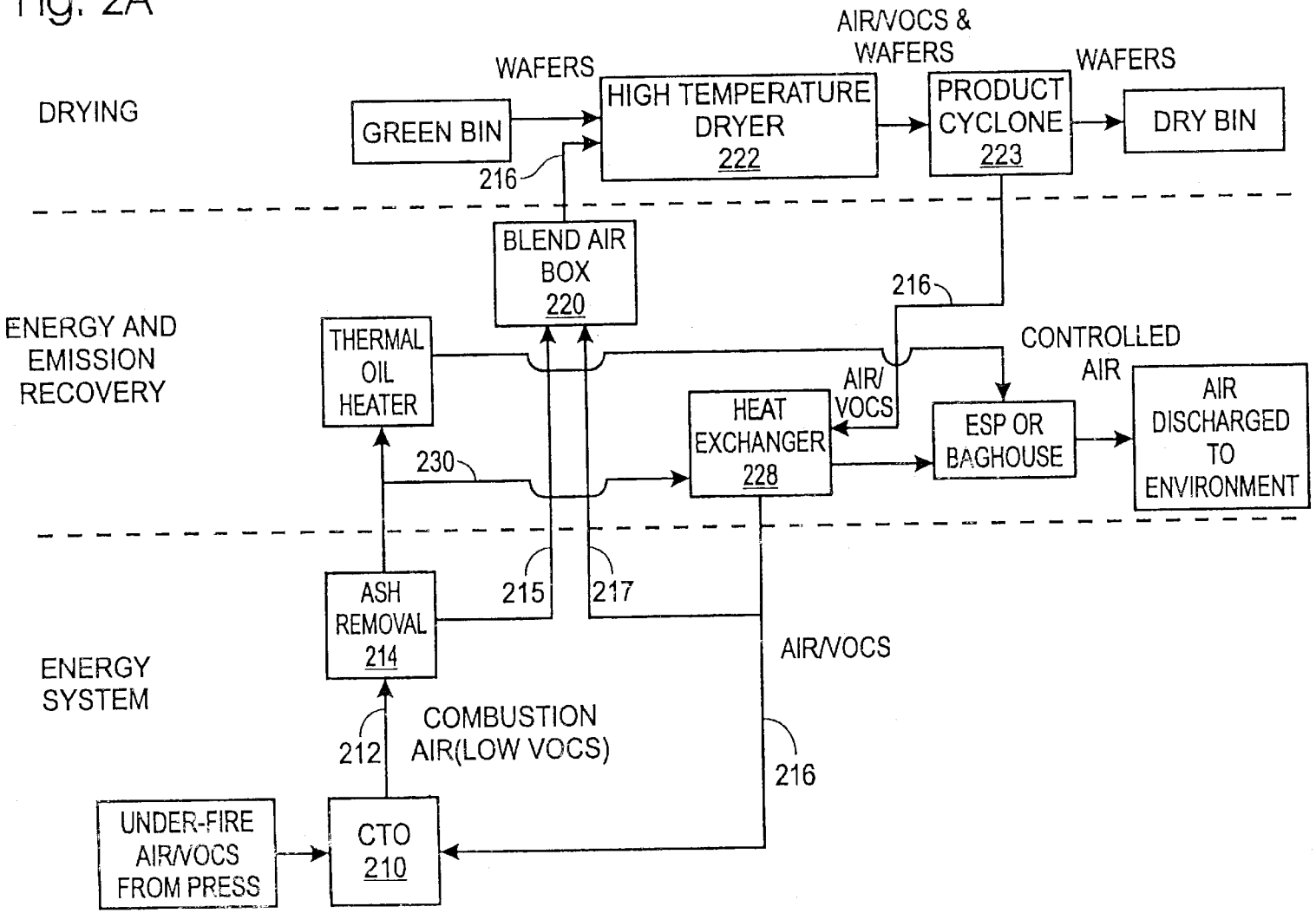
FIG. 2A is a schematic diagram of a second preferred embodiment of the invention wherein the exhaust stream from the combustion system is contacted directly with the green wafers, and wherein a portion of the VOC-containing gas stream from the wafer drier is recycled to the combustion system, and a portion is routed to a regenerative thermal oxidizer.
Figure 2B:
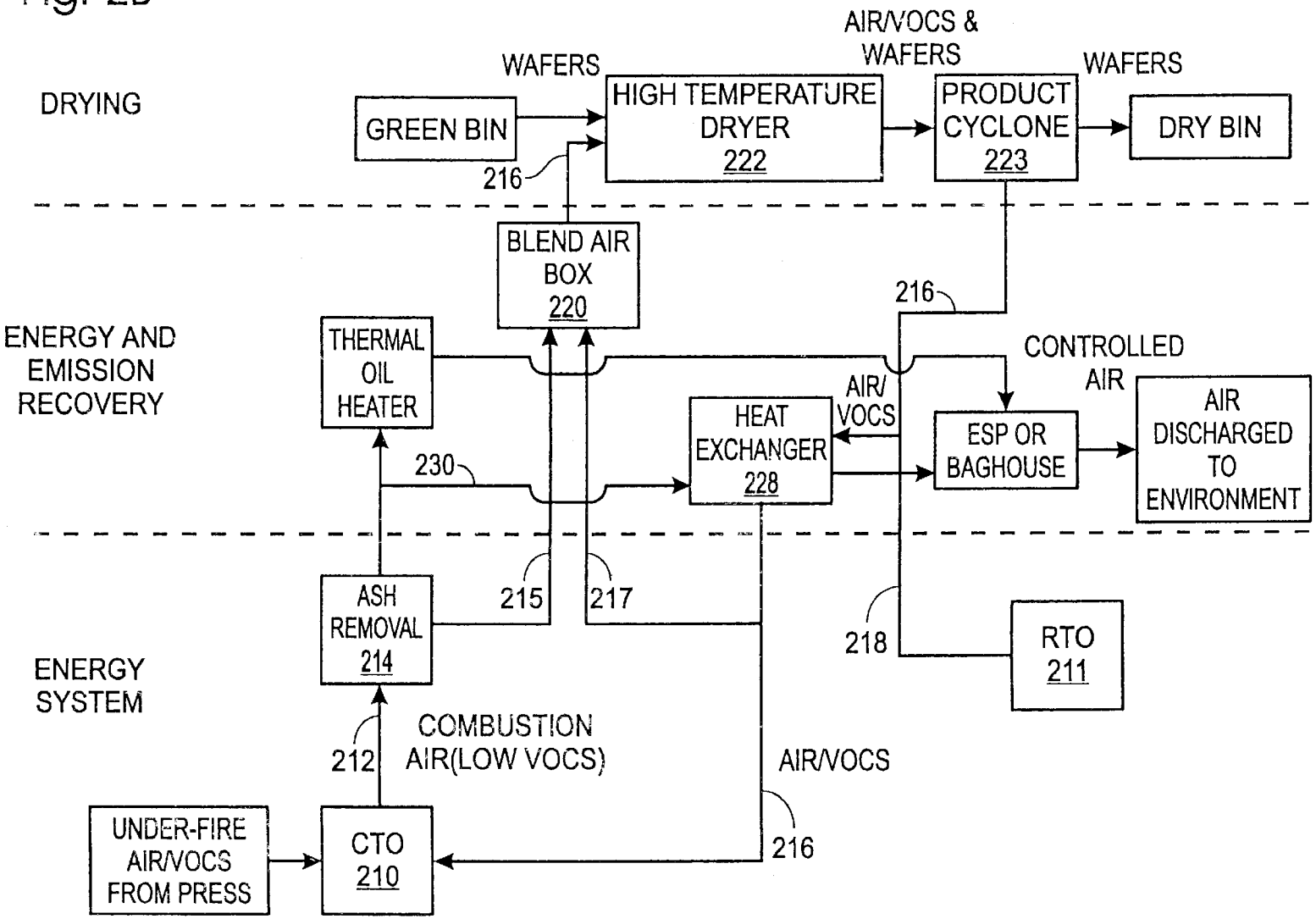
FIG. 2 is a schematic diagram of a first preferred embodiment of the invention wherein the exhaust stream from the combustion system is contacted directly with the green wafers, and wherein the VOC-containing gas stream from the wafer drier is recycled to the combustion system.

Turning now to FIG. 2, in a first embodiment of the invention a combustion system 210, such as wet cell burner such manufactured by GTS, is operated at about 1750 degrees F. Any continuous burner that operates at a combustion temperature of at least about 1500 degrees F. is within the scope of the invention. For purposes of this invention, the burner serves as both a source of heat for drying and as a continuous thermal oxidizer (CTO) as described in greater detail below. A flue gas stream 212 is discharged from the CTO and is introduced into a cyclone separator 214 where entrained ash and other particulate solids are removed. Stream 212 is then split into two streams. The first portion 215 of the flue gas stream, which remains at about 1750 degrees F., is introduced into a blend air box 220 where it is cooled to between about 1200 and 1400 degrees F. by being mixed with a fresh air stream at ambient temperature. The partially cooled stream 216 is then introduced into a direct contact dryer 222, along with "green" wafers. Dryer 222 is preferably a rotary dryer of known design. Other types of direct contact dryers could be substituted with comparable utility, and the invention is not intended to be limited to a particular type of direct contact dryer.

Within the dryer the green wafers are contacted directly by stream 216. This differs from prior art methods wherein the combustion gases are used to heat a second drying stream, which in turn contacts the wafers or other particles. As a result, the heat exchangers required in prior art methods are eliminated, providing a significant reduction in capital and operating costs. The wafers are dried to about a predetermined moisture content (such as about 5% on a dry wafer basis) before the wafers and stream 216 are discharged from dryer 222. At the same time, the flue gas stream 216 is cooled to about 240 degrees F. before exiting the dryer. During the drying process, VOC's are emitted from the green wafers and are entrained in flue gas stream 216. After being discharged from dryer 222, flue gas stream 216 and the dried wafers are directed into cyclone 223. The wafers are separated from flue gas stream 216 and placed into storage bin 224 to await further processing. In one preferred embodiment, the VOC-laden stream 216 is then routed into heat exchanger 228 where it is preheated by a second portion 230 of the flue gas stream to a temperature of between 600 and 900 degrees F. VOC-laden stream 216 is then fed into the combustion system 210. In one preferred embodiment shown in FIG. 2, a portion 217 of stream 216 is separated and reheated in blend air box 220, and is then recycled to dryer 222 for added thermal efficiency. Inside combustion system 210, which is operated at about 1750 degrees F., the VOC's in VOC-laden stream 216 are burned and destroyed. This method permits a reduction in the very expensive RTO capacity that would otherwise be necessary to control the VOC emissions. Another preferred embodiment shown in FIG. 2A differs from that shown in FIG. 2 in that under certain operating conditions, the volume of VOC-laden stream 216 exceeds that which can be accommodated by the recycle stream 217 and the combustion system 230. In those instances, the excess portion 218 of the VOC-laden stream 216 is fed to an RTO 211 for destruction of the VOC's. In just one example of this embodiment, of the total dryer output, about 42% is recyled to the dryer inlet; about 21% is recycled to the combustion system, and the remaining 37% is directed to RTO 211. This embodiment provides the greatest operating flexibility in that it accommodates the widest range of operating conditions, while providing a back-up capacity for the combustion system 210 for the destruction of the VOC's. This embodiment is also well suited for use in retrofitting existing plants with one or more RTO's already in place.

Figure 3:
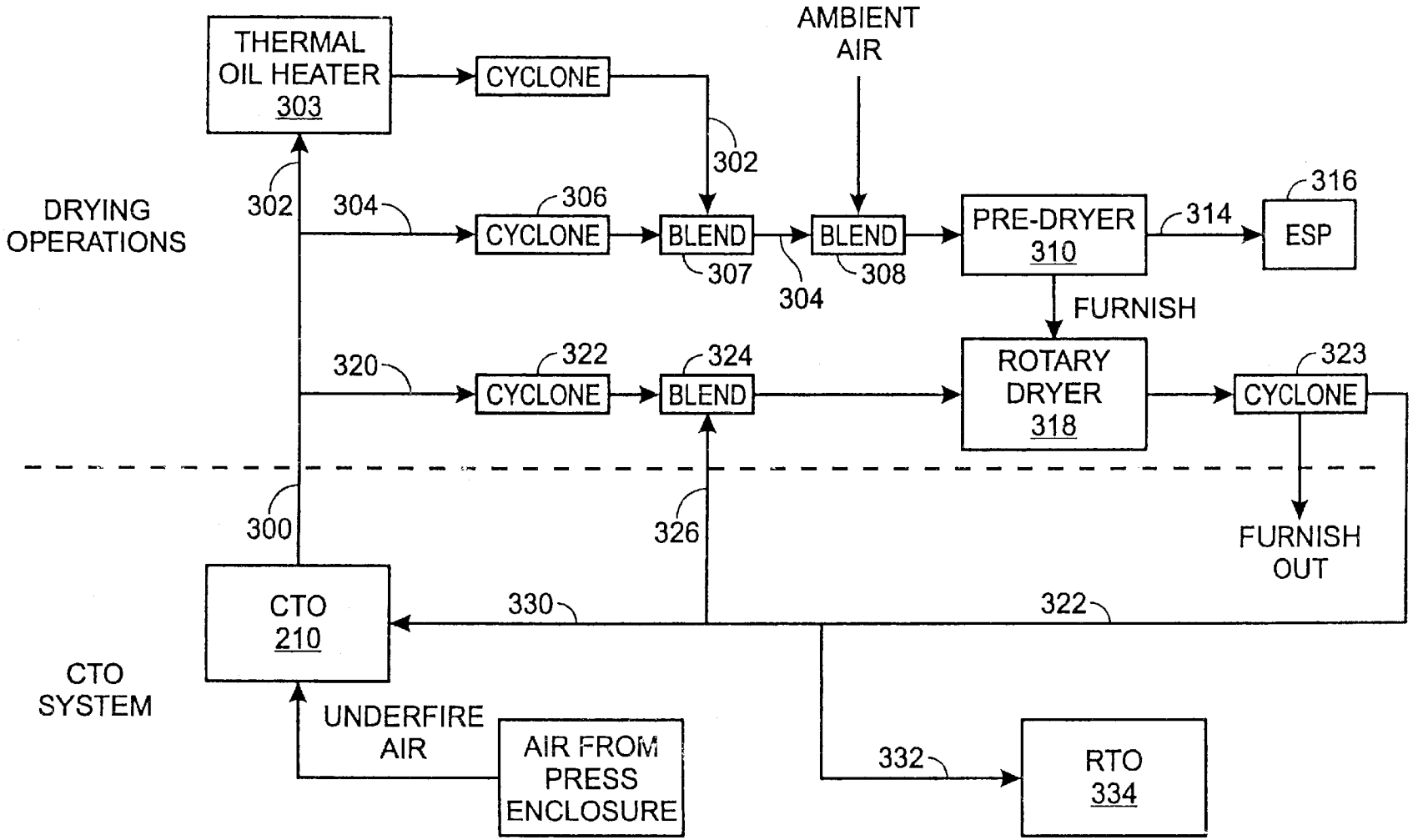
FIG. 3 is a schematic diagram of a second embodiment of the invention wherein the exhaust stream from the combustion system is contacted directly with the green wafers in successive drying stages, and wherein the VOC-containing gas stream from the wafer drier is recycled to the combustion system.

Referring now to FIG. 3, in another preferred embodiment of the invention, the drying of the wafers takes place in two stages. The flue gas stream 300 is split into three streams. A first stream 302 is directed to a thermal fluid heater 303, where thermal fluid is heated to provide intermediate process heat for the plant. A second stream 304 is directed through cyclone 306 to remove ash and other entrained solids. Stream 304 is then directed to fresh a air blend box where stream 304 is mixed with ambient air and cooled to about 400 degrees F. In the embodiment shown, stream 302 has been cooled as it passed through thermal fluid heater 303. Prior to blend box 308 stream 304 is mixed with stream 302 in blend box 307 and partially cooled. Stream 304 is then directed to pre-dryer 310. In pre-dryer 310 the green wafers are partially dried, typically to a moisture content of about 40–50% moisture content (calculated on a dry wafer basis).

In one novel aspect of the invention, applicant has discovered that VOC's are not emitted uniformly from the green wafers during drying. Instead, relatively small amounts of VOC's are emitted initially, and relatively large amounts of the VOC's in the wafers are emitted as the wafers are dried below the threshold moisture content. For example, most VOC's are emitted from aspen as the wafers are dried from about 40% to 5% of moisture content (dry wafer basis). Other wood varieties demonstrate similar characteristics, although the threshold moisture content below which the greater amount of VOC's is emitted varies; e.g. pine emits most of its VOC's below 50% of its original moisture content.

Accordingly, in this preferred embodiment of the invention, two sequential drying stages are utilized to take advantage of this phenomenon. In this embodiment, the wafers are first screened to remove fines (which tend to over dry and prematurely emit VOC's), and are then dried in pre-dryer 312 to about the threshold moisture content below which the majority of VOC's are emitted. The pre-dryer exhaust stream 314 is directed through electrostatic precipitator 316 to remove entrained solids, and is then discharged to the atmosphere, carrying with it very few VOC's. As in the previous embodiment, this advantageous arrangement reduces the required RTO capacity, and thereby provides significant economic benefits. The partially dried wafers are discharged from the predryer and are then fed to the second stage dryer 318, which in the preferred embodiment shown is a rotary dryer, although a conveyor dryer could also be used in the alternative. A third portion 320 of flue gas stream 300 is used to further dry the wafers in dryer 318. Stream 320 is separated from stream 300 and passed through cyclone 322 to separate ash and other entrained solids. Stream 320 is then cooled to about 1500° F. in blend box 324 by being mixed with stream 326, and is then introduced into dryer 318. Stream 320 then enters dryer 318 where it directly contacts the partially dried wafers. The wafers are dried from their intermediate moisture content of 40–50% of their original moisture content to about 8% or less. During this second drying stage, the gases and wafers are cooled to about 250° F. Also during this drying stage, most of the VOC's are emitted from the wafers and entrained in the gas stream 322. Gas stream 322 is a relatively low volume of gas compared to conventional drying methods, significantly reducing the difficulty of controlling VOC emissions from the plant. The VOC-laden gas stream 323 and the wafers are then discharged from the dryer and passed through cyclone 325. The separated wafers are sent to storage to await further processing into engineered wood products. The VOC-laden gas stream 327 is split into two portions. The first portion, stream 326, is recycled to blend box 324 to cool the incoming stream 320 as described above. The second portion 330 is sent to the combustion system 210 to provide combustion air and, more importantly, to destroy the VOC's emitted from the wafers. To the degree that the volume of stream 330 exceeds that which the combustion system 210 can utilize, a third portion 332 is directed to the RTO's for destruction of the VOC's therein. In an alternative embodiment, the combustion system exhaust stream portions 320 and 304 are introduced directly into blend box 324 and 307 respectively, without being first passed through cyclones 322 and 306 respectively.

Figure 4A:
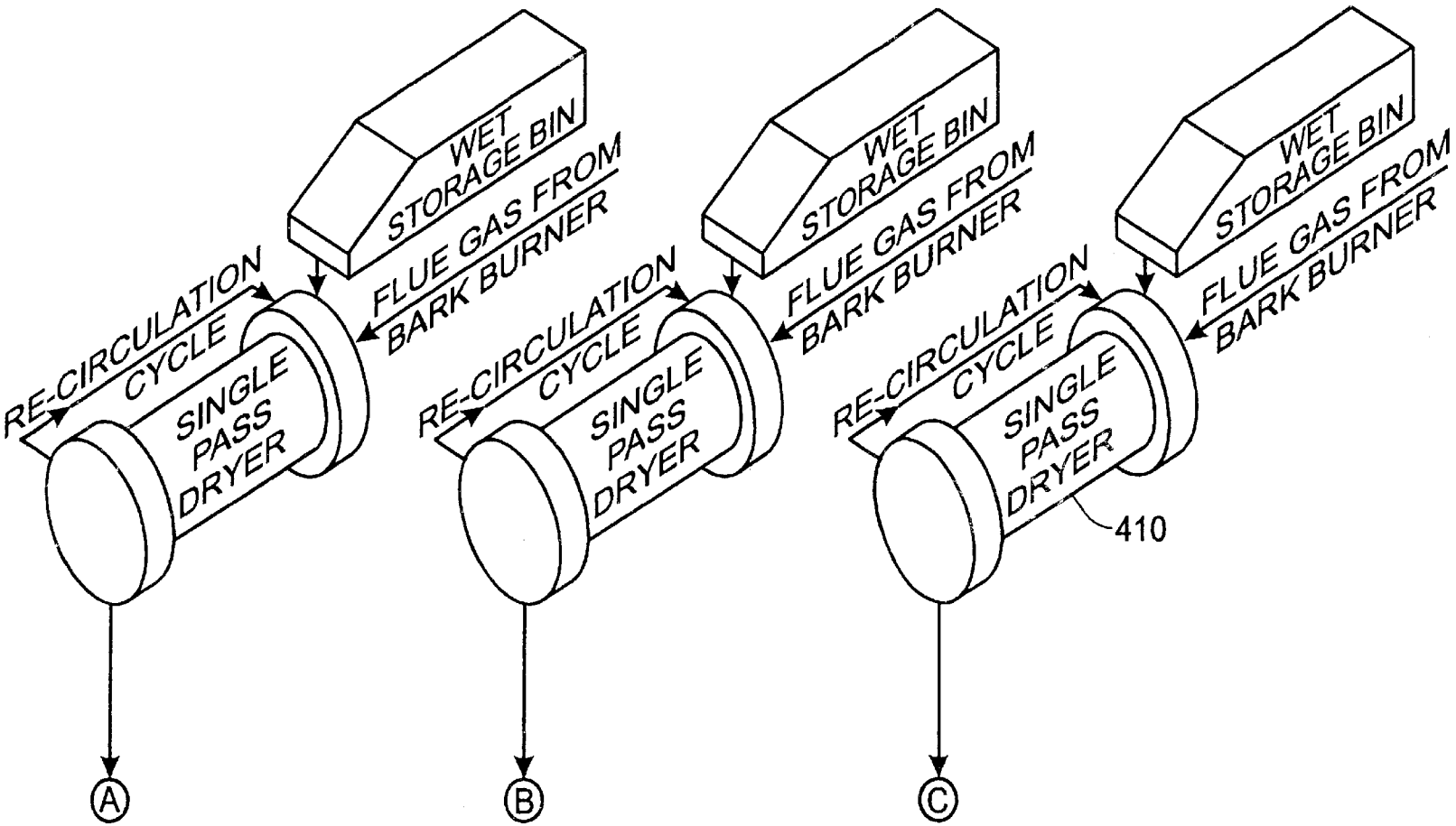
FIG. 4 is a schematic diagram of another embodiment in which two drying stages are utilized.
Figure 4B:
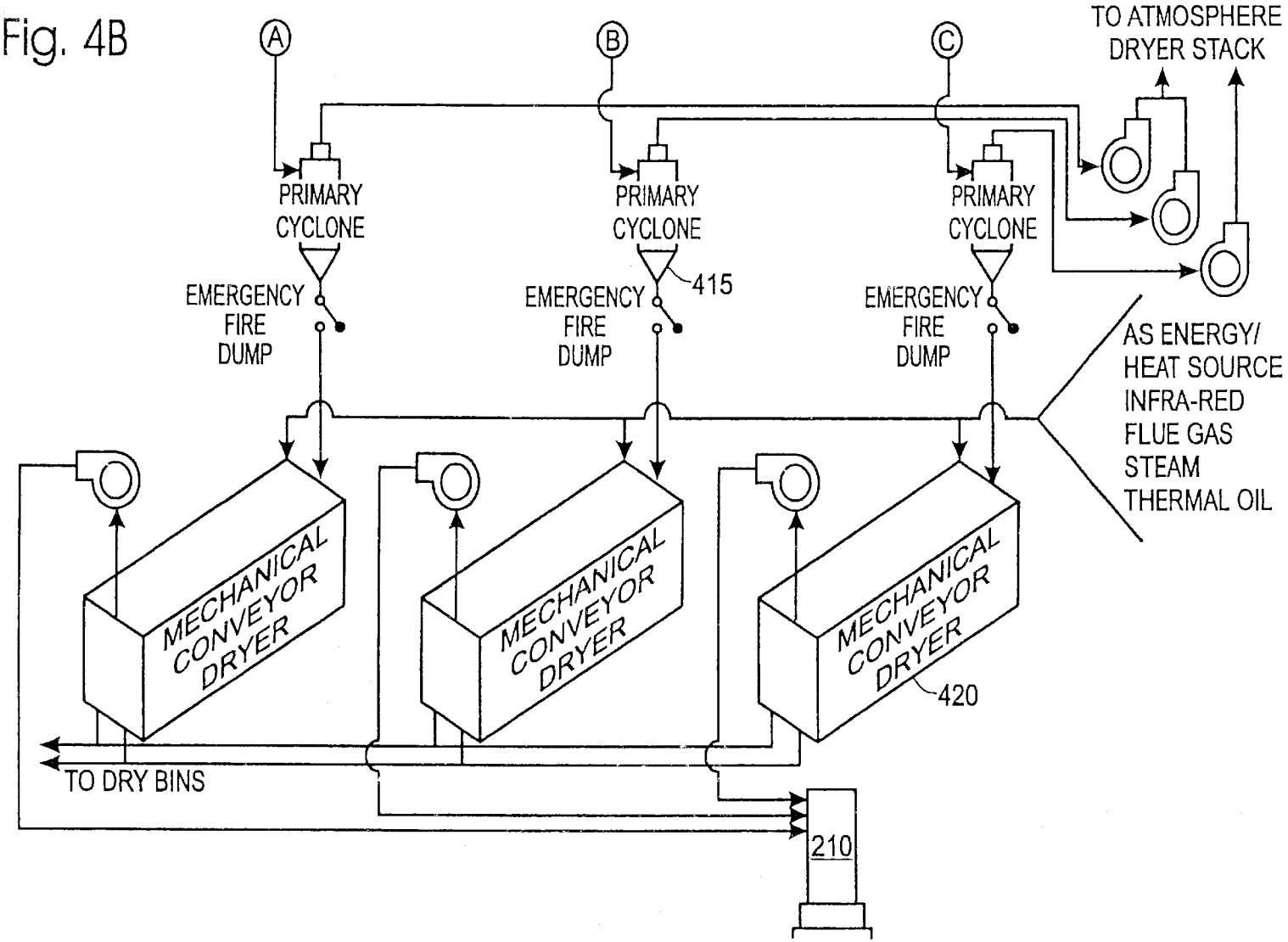
Figure 5A:
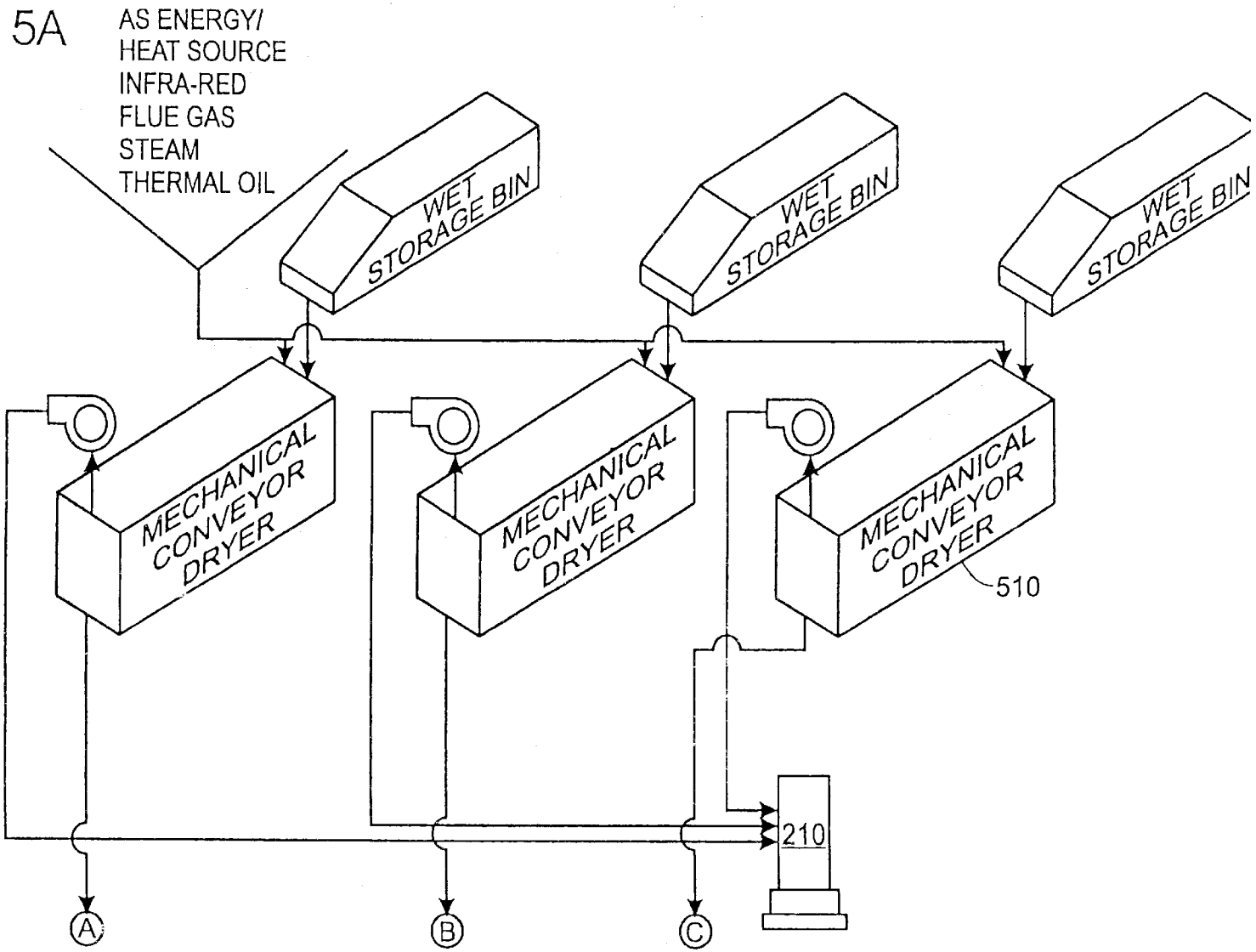
FIG. 5 is a schematic diagram of yet another embodiment in which two drying stages are utilized.
Figure 5B:
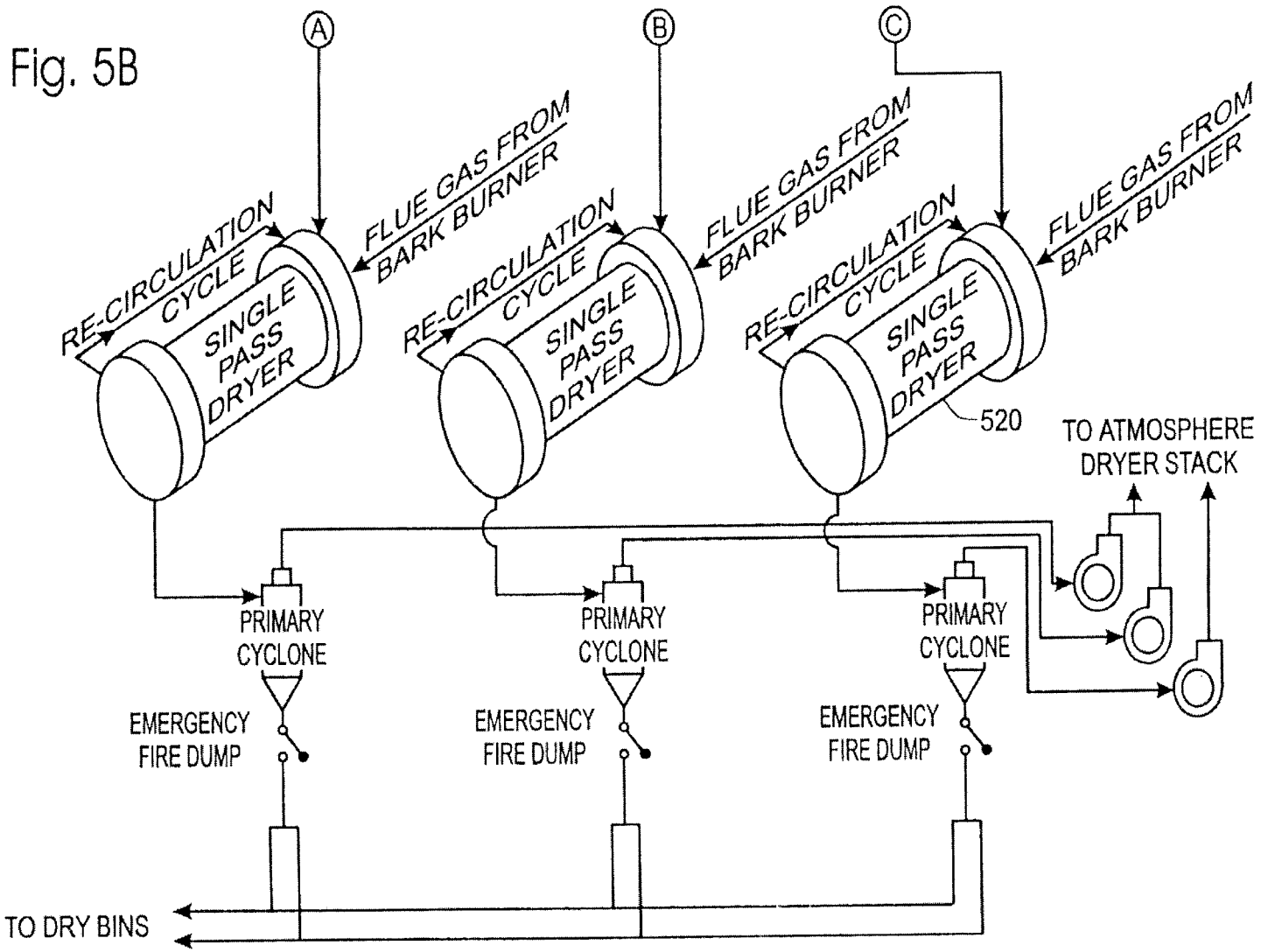

Turning now to FIGS. 4 and 5, particular embodiments utilizing two drying stages will be described in greater detail. One such embodiment is shown in FIG. 4. In this embodiment, the first drying stage is a single pass rotary dryer 410. Flue gas from the combustion system (FIG. 2) supplies heat to the first dryer 410, where the moisture content of the furnish is reduced to about the threshold level below which most VOC's are emitted in the drying process. As mentioned above, aspen is dried to about 50% moisture content in the first dryer stage. The temperature of the first stage dryer 410 is maintained below about 500 degrees F. At this temperature and level of drying, the majority of VOC's remain in the wafers. The single pass rotary dryer of the first drying stage 410 is of conventional design, and preferably utilizes a recycle stream of heated air (e.g. about 25%) to enhance the energy efficiency of the process. The partially dried wafers are passed through a cyclone 415. The partially dried furnish is then fed to the second drying stage 420 where the moisture content is reduced to its final value (e.g. about 10% of its initial moisture content), during which most of the VOC's are emitted. The second dryer stage 420 in this embodiment is a mechanical conveyor dryer, which provides several advantages. First and most importantly, a mechanical conveyor dryer required lower volumes of air than other types of dryers. Less air is required in part because the dryer includes air-reheating equipment inside the dryer, which allows for higher internal recycle rates within the dryer. In addition, the dryer does not rely on airflow for transport of the wafers, using a mechanical conveyor instead. By way of example, a mechanical conveyor dryer in a typical installation might require only 40% or less of the air volume required by the first stage dryer to process the same amount of furnish. After the furnish has been dried to the desired moisture content, the VOC-laden air stream is delivered to the combustion system 210 for combustion therein as discussed above.

Turning now to FIG. 5, another preferred embodiment is shown and wherein the wafers (softwood wafers for example) emit the majority of their VOC's during the first drying stage rather than the second. In this embodiment, the order of the drying stages is reversed, with the "low air volume"-moving moving conveyor dryer 510 preceding the higher air volume single pass rotary dryer 520. In this embodiment, the respective stages operate substantially as described above although in reverse order. It should be noted that in this second embodiment, where the single pass rotary dryer is utilized as the second stage dryer 520, the final moisture content of the wafers can be more precisely controlled.

Another preferred embodiment, which is particularly useful for drying yellow pine, differs from that shown in FIG. 5 in that a radio frequency (RF) dryer is used as the second stage dryer instead of a rotary drier. The particulate material is dried to about 15% of its initial moisture content in the first stage dryer, and to about 4–7% in the second stage. The RF second stage dryer is particularly useful in preventing the over drying of the yellow pine particles, which can cause resin bleed in the final product. The RF dryer has other advantages as well. It uses radio frequency radiation rather than a heated air stream to dry the wafers. As a result, a relatively small amount of air having a relatively high VOC concentration can be continuously bled from the dryer and fed to the combustion system.

By utilizing the drying methods described above, the required RTO capacity of the plant can be reduced by up to one half or more, resulting in a significant savings in the capital and operating costs of the plant. In addition, one or more heat exchangers can be eliminated from prior art methods.

The foregoing is intended to be illustrative rather than limiting. Those skilled in the art will recognize that the described embodiments can be modified in detail without departing from the spirit and scope of the following claims.

What is claimed is:

1. A method of drying a cellulosic material comprising the steps of:

a. discharging an exhaust stream from a combustion device;

b. directly contacting a first portion of the exhaust stream with a cellulosic material;

c. transferring volatile organic compounds from the cellulosic material to the first exhaust stream portion; and d. introducing at least a portion of the first exhaust stream into the combustion device and destroying the volatile organic compounds therein.

2. A method according to claim 1, further comprising the combustion exhaust stream having a temperature of at least about 1500 degrees Fahrenheit immediately prior to contacting the cellulosic material.

3. A method according to claim 1, wherein the step of contacting a first portion of the exhaust stream with a cellulosic material includes introducing the first portion of the exhaust stream and the cellulosic material into a first direct contact dryer.

4. A method according to claim 3, wherein the first direct contact heat dryer is selected from the group consisting of a rotary drier, a conveyor drier, and a multi-zone conveyor drier.

5. A method according to claim 3, wherein the first direct contact drier is operated with a portion of the first exhaust stream leaving the first direct contact drier being recycled to the direct contact drier inlet.

6. A method according to claim 5, wherein at least about 25 percent of the exhaust stream leaving the first direct contact drier is recycled to the first direct contact drier inlet.

7. A method according to claim 5, wherein at least about 40 percent of the exhaust stream leaving the first direct contact drier is recycled to the first direct contact drier inlet.

8. A method according to claim 3, wherein at least about 20 percent of the exhaust stream leaving the first direct contact drier is recycled to the combustion device.

9. A method according to claim 1, wherein the combustion exhaust stream is at a temperature of at least about 1000 degrees F.

10. A method according to claim 1, wherein the combustion exhaust stream is at a temperature of at least about 1200 degrees F.

11. A method according to claim 1, wherein the combustion exhaust stream is at a temperature of at least about 1400 degrees F.

12. A method according to claim 1, which further comprises introducing at least a portion of a dryer exhaust stream portion into a regenerative thermal oxidizer.

13. A method of drying a cellulosic material comprising the steps of: providing a combustion exhaust stream from a combustion device;

splitting the combustion exhaust stream into at least first and second portions;

contacting a cellulosic material with the first exhaust stream portion and thereby drying the cellulosic material to a first predetermined moisture content;

contacting the partially dried cellulosic material with the second combustion exhaust stream portion thereby drying the cellulosic material to a second predetermined moisture content, and thereby transferring a majority of volatile organic compounds from the cellulosic material into the second combustion exhaust stream portion;

introducing at least a portion of the dryer exhaust stream portion into the combustion device, thereby destroying the volatile organic compounds therein; and introducing at least a portion of the first exhaust stream portion into the combustion device and destroying the volatile organic compounds therein.

14. A method according to claim 13, wherein the combustion exhaust stream is at a temperature of at least about 1000 degrees F.

15. A method according to claim 13, wherein the combustion exhaust stream is at a temperature of at least about 1200 degrees F.

16. A method according to claim 13, wherein the combustion exhaust stream is at a temperature of at least about 1400 degrees F.

17. A method according to claim 13, which further comprises introducing at least a portion of the dryer exhaust stream portion into a regenerative thermal oxidizer.

18. A method according to claim 13, further comprising the combustion exhaust stream having a temperature of at least about 1500 degrees Fahrenheit immediately prior to contacting the cellulosic material.

19. A method according to claim 13, wherein the step of contacting a first portion of the exhaust stream with a cellulosic material includes introducing the first portion of the exhaust stream and the cellulosic material into a first direct contact dryer.

20. A method according to claim 19, wherein the first direct contact heat dryer is selected from the group consisting of a rotary drier, a conveyor drier, and a multi-zone conveyor drier.

21. A method according to claim 19, which further includes the step of introducing the cellulosic material and a second portion of the exhaust stream into a second direct contact dryer.

22. A method according to claim 21 wherein the second direct contact dryer is selected from the group consisting of a rotary drier, a conveyor drier, a multi-zone conveyor drier and a radio frequency dryer.

23. A method according to claim 21, wherein the cellulosic material is dried in the first direct contact drier to a predetermined moisture level below which a majority of VOC's in the cellulosic material are volatized from the cellulosic material, and the cellulosic material is further dried in the second direct contact drier.

24. A method according to claim 19, wherein the first direct contact drier is operated with a portion of the first exhaust stream leaving the first direct contact drier being recycled to the first direct contact drier inlet.

25. A method according to claim 24, wherein at least about 25 percent of the exhaust stream leaving the first direct contact drier is recycled to the first direct contact drier inlet.

26. A method according to claim 24, wherein at least about 40 percent of the exhaust stream leaving the first direct contact drier is recycled to the first direct contact drier inlet.

27. A method according to claim 19, wherein at least about 20 percent of the exhaust stream leaving the first direct contact drier is recycled to the combustion device.

28. A method of drying a cellulosic material comprising the steps of: discharging an exhaust stream from a combustion device;

directly contacting a first portion of the exhaust stream with a cellulosic material in a first direct contact dryer;

transferring volatile organic compounds from the cellulosic material to the first exhaust stream portion;

introducing at least a portion of the first exhaust stream into the combustion device and destroying the volatile organic compounds therein; and introducing the cellulosic material and a second portion of the exhaust stream into a second direct contact dryer.

29. A method according to claim 28, further comprising the combustion exhaust stream having a temperature of at least about 1500 degrees Fahrenheit immediately prior to contacting the cellulosic material.

30. A method according to claim 28, wherein the first direct contact heat dryer is selected from the group consisting of a rotary drier, a conveyor drier, and a multi-zone conveyor drier.

31. A method according to claim 28, wherein the second direct contact dryer is selected from the group consisting of a rotary drier, a conveyor drier, a multi-zone conveyor drier and a radio frequency dryer.

32. A method according to claim 28, wherein the cellulosic material is dried in the first direct contact drier to a predetermined moisture level below which a majority of VOC's in the cellulosic material are volatized from the cellulosic material, and the cellulosic material is fiuther dried in the second direct contact drier.

33. A method according to claim 28, wherein the first direct contact drier is operated with a portion of the first exhaust stream leaving the first direct contact drier being recycled to the first direct contact drier inlet.

34. A method according to claim 28, wherein at least about 25 percent of the exhaust stream leaving the first direct contact drier is recycled to the first direct contact drier inlet.

35. A method according to claim 28, wherein at least about 40 percent of the exhaust stream leaving the first direct contact drier is recycled to the first direct contact drier inlet.

36. A method according to claim 28, wherein at least about 20 percent of the exhaust stream leaving the first direct contact drier is recycled to the combustion device.

* * * * *